US006378863B1

(12) United States Patent
Kunde et al.

(10) Patent No.: US 6,378,863 B1
(45) Date of Patent: Apr. 30, 2002

(54) METHOD AND CONFIGURATION FOR CONTROLLING THE PASSAGE OF PRINTED MEDIA

(75) Inventors: Christoph Kunde, Berlin; Michael Schmidt-Kretschmer, Lehnitz, both of (DE)

(73) Assignee: Francotyp Postalia AG & Co., Birkenwerder (DE)

( * ) Notice: Subject to any disclaimer, the term of this patent is extended or adjusted under 35 U.S.C. 154(b) by 0 days.

(21) Appl. No.: 09/528,421

(22) Filed: Mar. 17, 2000

(30) Foreign Application Priority Data

Mar. 17, 1999 (DE) ..... 199 13 065

(51) Int. Cl.[7] ..... B65H 7/02

(52) U.S. Cl. ..... 271/258.01; 271/3.17; 271/3.15; 271/3.16; 209/584; 209/900; 209/910

(58) Field of Search ..... 209/900, 910, 209/584; 271/2, 256, 258.01, 3.17, 3.15, 3.16, 265.01, 265.02

(56) References Cited

U.S. PATENT DOCUMENTS 4,573,673 A 3/1986 Haug
4,787,311 A * 11/1988 Mol ..... 101/232
6,005,212 A * 12/1999 Van Lierde et al. ..... 209/586

FOREIGN PATENT DOCUMENTS

| | | |
|---|---|---|
| EP | 0 057 810 A1 | 8/1982 |
| EP | 0 503 502 A2 | 9/1992 |
| WO | WO 92/16444 | 10/1992 |

* cited by examiner

*Primary Examiner*—Donald P. Walsh
*Assistant Examiner*—Jonathan R. Miller
(74) *Attorney, Agent, or Firm*—Herbert L. Lerner; Laurence A. Greenberg; Werner H. Stemer

(57) ABSTRACT

A method and a configuration for controlling the passage of printed media, especially letters or envelopes, in a separating apparatus of a mail processing system, include transferring the printed media, on the output side, with an ejector to a following device, such as a scale or balance or a franking machine. The intention is to widen the field of use and the throughput of printed media is to be matched to that in the following device. A transfer speed is set on the basis of a transport speed of the following device and, in remaining areas of the separating apparatus, the transport speed is optimized on the basis of a respective printed medium position.

17 Claims, 5 Drawing Sheets

METHOD AND CONFIGURATION FOR CONTROLLING THE PASSAGE OF PRINTED MEDIA

BACKGROUND OF THE INVENTION

Field of the Invention

The invention relates to a method for controlling the passage of printed media, especially of letters or envelopes, in a separating apparatus of a mail processing system. In that case, the letters can have different thicknesses and permissible formats in an irregular sequence. The processing of printed media occurring in that way is referred to as mixed mail operation.

Mail processing systems normally include:

- a separating apparatus, in which the printed media are placed successively in stacks, separated and closed as required,
- a franking and/or addressing machine with an optional integrated or preceding scale or balance, and
- a depositing apparatus.

Reference is made in that regard to German Utility Model DE-M 96 09 167.3 in the Registered Design Bulletin of the German Patent Office dated May 24, 1997, Part Ia, Goods Class 18/02.

In mail processing systems of that type, it is difficult to achieve the greatest possible throughput per unit time. As a rule, an upper limit for the letter or envelope throughout is determined by a transport and printing speed of the franking machine. Consequently, it is worth attempting to match the throughput in the preceding devices to that upper limit.

A method of operating a high-speed mail processing machine for processing mixed mail of different thicknesses and different dimensions is known from European Patent EP 0 503 502 B1. The method includes the steps of conveying each postal item to a weighing station, weighing it and then printing a postage stamp. Those steps are activated and controlled by a drive control system corresponding to a number of sensors. The sensors are distributed around the machine, some of them being optical sensors. In addition, in that method, a specific sensor processor is caused to make access to the sensors and inform the drive control system about their state, after the drive control system has previously been activated. The access step includes the periodic execution of a main cycle in order, in that way, to make access to each sensor of a first group during each cycle, and to make access to each sensor in a second group only during some cycles but not all cycles. The sensor data are written into a RAM, to which the control system can make access.

Furthermore, a configuration for pre-separating printed media is known from German Published, Non-Prosecuted Patent Application DE 196 05 017 A1, in which the letters or envelopes, standing on one edge, are deposited one after another as a letter or envelope stack, and the letters are fed laterally away from the letter or envelope stack to a separating apparatus. In that case, the letters or envelopes are disposed between a spring-mounted pressure clip and at least one drive roll and a guide plate which is inclined slightly rearward. The standing surface for the letters or envelopes and the guide plate are orthogonal to each other.

Finally, a further apparatus for separating printed media, especially letters or envelopes, has been found, corresponding to German Published, Non-Prosecuted Patent Application DE 198 36 235 A1, corresponding to U.S. application Ser. No. 09/368,645, filed Aug. 5, 1999. That apparatus will be explained in more detail below with regard to FIG. 1.

SUMMARY OF THE INVENTION

It is accordingly an object of the invention to provide a method and a configuration for controlling the passage of printed media, which overcome the hereinafore-mentioned disadvantages of the heretofore-known methods and devices of this general type, which match a throughput of letters or envelopes in a separating apparatus of the above-described type to a throughput of following devices, especially a following franking machine, and which improve service properties.

With the foregoing and other objects in view there is provided, in accordance with the invention, a method for controlling the passage of printed media, especially letters or envelopes, in a mail processing system, which comprises transporting printed media laterally away from a stack; providing a separating apparatus with different successive functional areas and a transition area between the functional areas; transporting the printed media more quickly in the functional area preceding the respective transition area, than in the respective transition area, until a printed medium has reached the transition area; transferring the printed media at a transfer speed to a following device having a transport speed; and adapting the transfer speed leading to the respective following device to the transport speed of the following device.

The invention is based on the concept that, in the franking machine, there must be a minimum distance from the leading edge to the leading edge of letters or envelopes which follow one another. This distance corresponds to the longest franking impression plus the width of the printing head plus a safety margin. Therefore, at least initially, the distance in the case of small short letters or envelopes is predefined. In the case of larger or longer letters or envelopes, the distance from leading edge to leading edge is necessarily greater than this minimum distance. In this case, the point is to keep the distance between the long letter or envelope and the following letter or envelope as small as possible and/or to achieve the greatest possible throughput.

Through the use of the invention, this problem is solved by controlling the transport speed in the individual passage areas of the letters or envelopes in the separating apparatus. Depending on the transport speed of the following device, the transfer speed is adapted to the latter. Therefore, the formation of a build-up in the following device is prevented from this side.

In accordance with another mode of the invention, the transport speed in the separating area is set to be higher than the transfer speed, until a letter or envelope has passed into the ejection area. This corresponds to accelerated transport in the separating area. This serves to increase the throughput in general and to reduce the distance between successive letters or envelopes in particular.

The transport speed in the separating area is set to be lower than or equal to the transfer speed, as long as there is a letter or envelope in the ejection area. This corresponds to normal transport in the separating area. This prevents the formation of a build-up upstream of the ejection area.

The transport speed in the pre-separating area is set to be higher than the transfer speed and higher than the increased transport speed in the separating area, as long as there is no letter or envelope in the input area of the separating area. This corresponds to accelerated transport in the pre-separating area. This likewise serves to increase the throughput in general and to reduce the distance between successive letters or envelopes in particular.

The transport speed in the pre-separating area is set to be lower than or equal to the normal transport speed in the separating area if a letter or envelope has reached the input area of the separating area and there is no further letter or envelope upstream of the ejection area. This corresponds to normal transport in the pre-separating area. This avoids the formation of a build-up in the input area of the separating area.

The transport speed in the pre-separating area is set to zero as long as there is a letter or envelope in the input area and in the other areas of the separating area. This corresponds to stopped operation or idling operation in the pre-separating area. This prevents the formation of a build-up or multiple extraction.

In accordance with a further mode of the invention, the transfer speed to the following device, that is the transport speed which is produced by the ejection roll pair, is continuously monitored. It is always lower than or equal to the transport speed set in the following device but kept somewhat higher, approximately 10%, than the transport speed in the initial area of the separating area, that is the transport speed produced by the separating elements. In addition, the transport speed in the pre-separating area, which is produced by the drive rolls with accelerated transport, is set to be correspondingly higher, approximately 30%, than the transfer speed in the separating area.

In accordance with an added mode of the invention, the letter or envelope is scanned in the input area of the separating area and immediately after being separated, in order to derive appropriate control signals for the drive in the pre-separating area and in the separating area, in combination with further scanning results.

In accordance with an additional mode of the invention, the letter or envelope is scanned in the ejection area of the separating apparatus in order to derive appropriate control signals therefrom for the pre-separating area, the separating area and the following device.

With the objects of the invention in view, there is also provided, in a mail processing system including a separating apparatus having a pre-separating area, a separating area and an ejection area, and a following device downstream of the separating apparatus, a configuration for controlling the passage of printed media in the mail processing system, the configuration comprising a drive disposed in the pre-separating area; a drive disposed in the separating area; a first encoder sensor for measuring a transfer speed of the printed media to the following device; a second sensor disposed in the ejection area for scanning printed media; a third sensor disposed in an input area of the separating area for detecting printed media; a fourth sensor disposed downstream of a separation in the separating area for detecting printed media; and an evaluation circuit connected to the first, second, third and fourth sensors, the evaluation circuit connected to the drives of the pre-separating and separating areas and bidirectionally connected to the following device, for outputting control signals.

In accordance with another feature of the invention, there is provided an ejector in the ejection area having an ejection roll pair including a stationary driven ejection roll and a spring-adjustable, indirectly driven ejection roll; the indirectly driven ejection roll connected synchronously to the first sensor; the first sensor supplying an output signal; and the evaluation circuit comparing the output signal supplied by the first sensor with a value corresponding to a transport speed in the following device, to provide a result supplied as a control signal to the drives in the pre-separating area and the separating area.

In accordance with a further feature of the invention, the ejection rolls define a line of contact therebetween, and the second sensor is disposed upstream or downstream of the line of contact.

In accordance with an added feature of the invention, the second, third and fourth sensors are reflection sensors.

In accordance with an additional feature of the invention, the second, third and fourth sensors for detecting printed media supply output signals; and the evaluation circuit combines the output signals from the second, third and fourth sensors for setting the drive in the pre-separating area to accelerated transport if the third sensor does not detect a printed medium; setting the drive in the pre-separating area to normal transport if the third sensor detects a printed medium and the fourth sensor does not detect a printed medium; setting the drive in the pre-separating area to idle if the third sensor and the fourth sensor detect a printed medium; setting the drive in the separating area to accelerated transport if the second sensor does not detect a printed medium; and setting the drive in the separating area to normal transport if the fourth sensor detects a printed medium.

In accordance with a concomitant feature of the invention, the output signal from the second sensor is also used for communication with the following device.

Other features which are considered as characteristic for the invention are set forth in the appended claims.

Although the invention is illustrated and described herein as embodied in a method and a configuration for controlling the passage of printed media, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

The drawings have been made in diagrammatic form for the purpose of simplification and for ease of understanding. The term "letter" will be used below instead of the terms "envelope" or "printed medium" for the sake of brevity.

Figure 1:
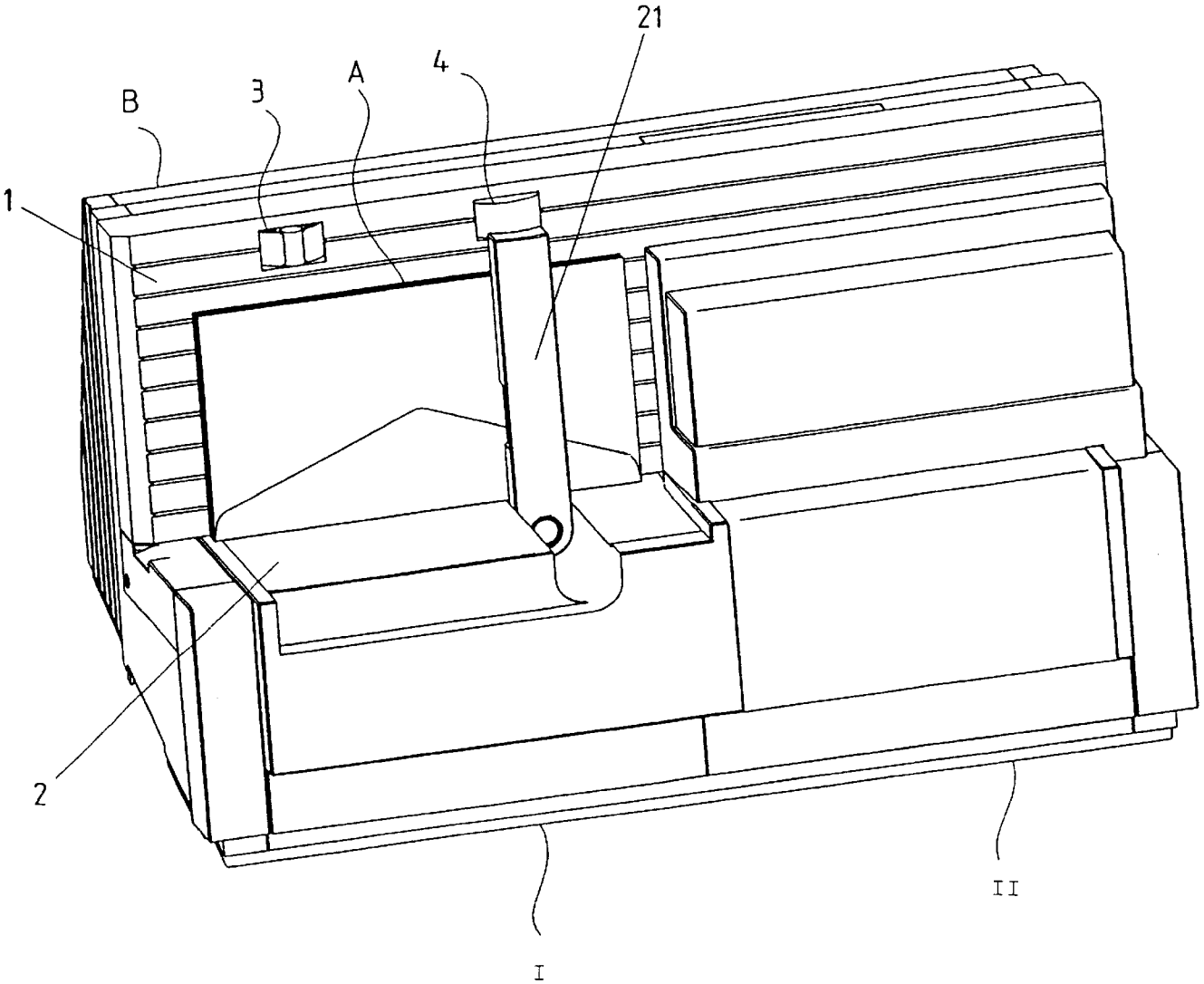
FIG. 1 is a diagrammatic, left and front perspective view of a letter or envelope separating apparatus according to German Published, Non-Prosecuted Patent Application DE 198 36 235 A1, corresponding to U.S. application Ser. No. 09/368,645, filed Aug. 5, 1999.

Referring now to the figures of the drawings in detail and first, particularly, to FIG. 1 thereof, which illustrates an apparatus according to German Published, Non-Prosecuted Patent Application DE 198 36 235 A1, corresponding to U.S. application Ser. No. 09/368,645, filed Aug. 5, 1999, there is seen an apparatus for separating printed media, especially letters or envelopes, in which letters A are stacked one behind another in a separating apparatus B. The letters A stand with one edge on a lower guide plate 2 and are disposed between a spring-mounted pressure clip 21, drive roll combinations 3, 4 and a guide plate 1 which is inclined slightly rearward. The drive rolls have cylindrical enveloping surfaces which project through openings in the guide plate 1, and the letters A are laterally transported along individually by the drive rolls.

Figure 2:
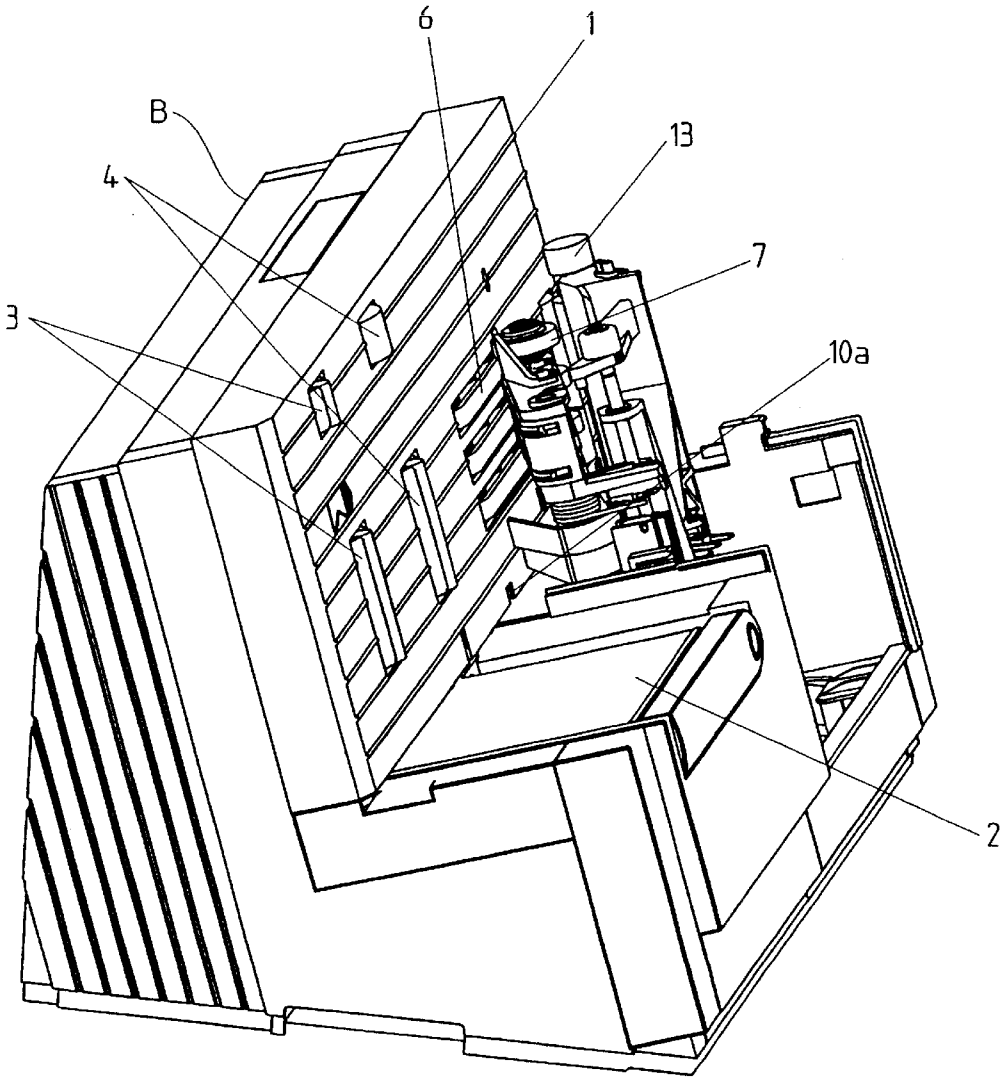
FIG. 2 is a top, left and front perspective view corresponding to FIG. 1.
Figure 3:
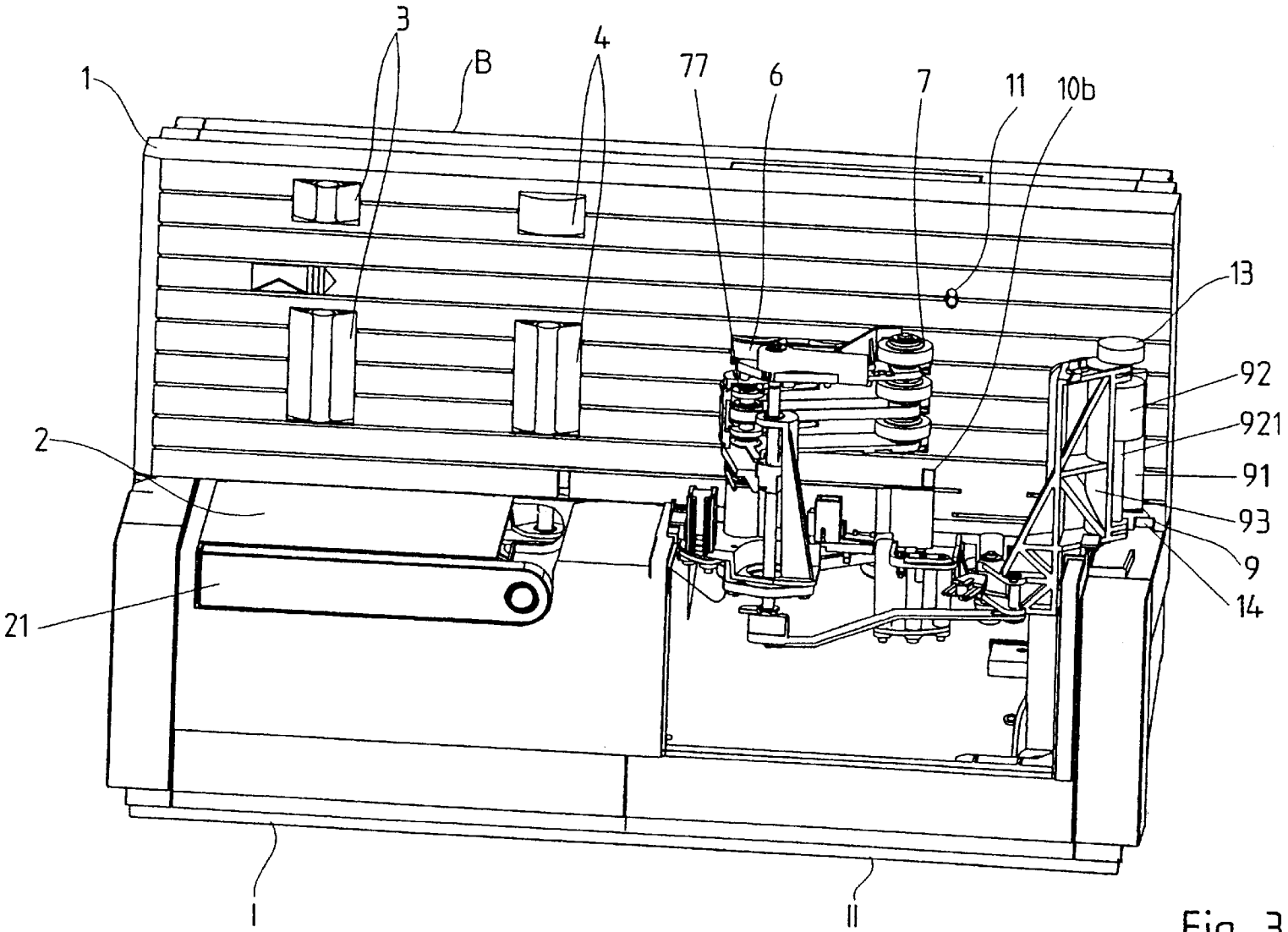
FIG. 3 is a partly cut or broken-away right and front perspective view corresponding to FIG. 1.

Functionally, the separating apparatus B is divided into a pre-separating area I with two drive roll combinations 3, 4 in start/stop operation, and a separating area II with elements 6, 7, 77 for separating with continuous throughput, as is best seen in FIGS. 2 and 3. The areas I and II may be referred to as functional areas and an area between them may be referred to as a transition area. In addition, a fourth sensor 10*b* for detecting printed media and an ejector 9 in the form of an ejection roll pair 91, 92 are also present in the separating area II.

The separating elements 6, 7, 77 include a drive belt combination 6, a driven mating roller combination 7 matched to the latter, and a likewise matched, preceding sliding lever combination 77. The sensor 10*b* is disposed in the vicinity of the mating roller combination 7 and is linked electrically to a drive 5 for the two drive roll combinations 3, 4 in such a way that the drive 5 is switched on each time when the sensor 10*b* detects an end or trailing edge of a printed medium.

The ejection roll pair 91, 92 includes a driven ejection roll 91 and an indirectly driven ejection roll 92. The driven ejection roll 91 is fixed on a rotatable shaft 911 behind the guide plate 1 and projects partly through a matched opening in the same. The indirectly driven ejection roll 92 is fixed on a likewise rotatable shaft 921 in front of the guide plate 1, as is seen in particular in FIGS. 2 and 3. The shaft 921 is mounted in such a way that it can rotate on a rotatably spring-mounted carrying lever 93. A common drive 8 is provided for the drive belt combination 6, the mating roller combination 7 together with the sliding lever combination 77 and the ejection roll pair 91, 92.

According to FIG. 2, a third optical sensor 10*a* is disposed in an input area of the drive belt combination 6 and the sliding lever combination 77, in an appropriately adapted opening in the rear guide plate 1. The sensor 10*a* is expediently constructed as a reflection sensor. This sensor 10*a* is used to establish whether the letter A has penetrated into this area or is still located in this area.

According to FIG. 3, the optical sensor 10*b* is disposed directly downstream of the drive belt combination 6 and/or the mating roller combination 7, in an appropriately adapted opening in the rear guide plate 1. The sensor 10*b* is expediently likewise constructed as a reflection sensor. This sensor 10*b* is used to establish whether or not there is a letter A in this area.

The ejection roll pair 91, 92 is disposed at such a distance downstream of the mating roller combination 7 that even the shortest possible letter A is already gripped by the ejection roll pair before the letter has left the mating roller combination 7.

Figure 4:
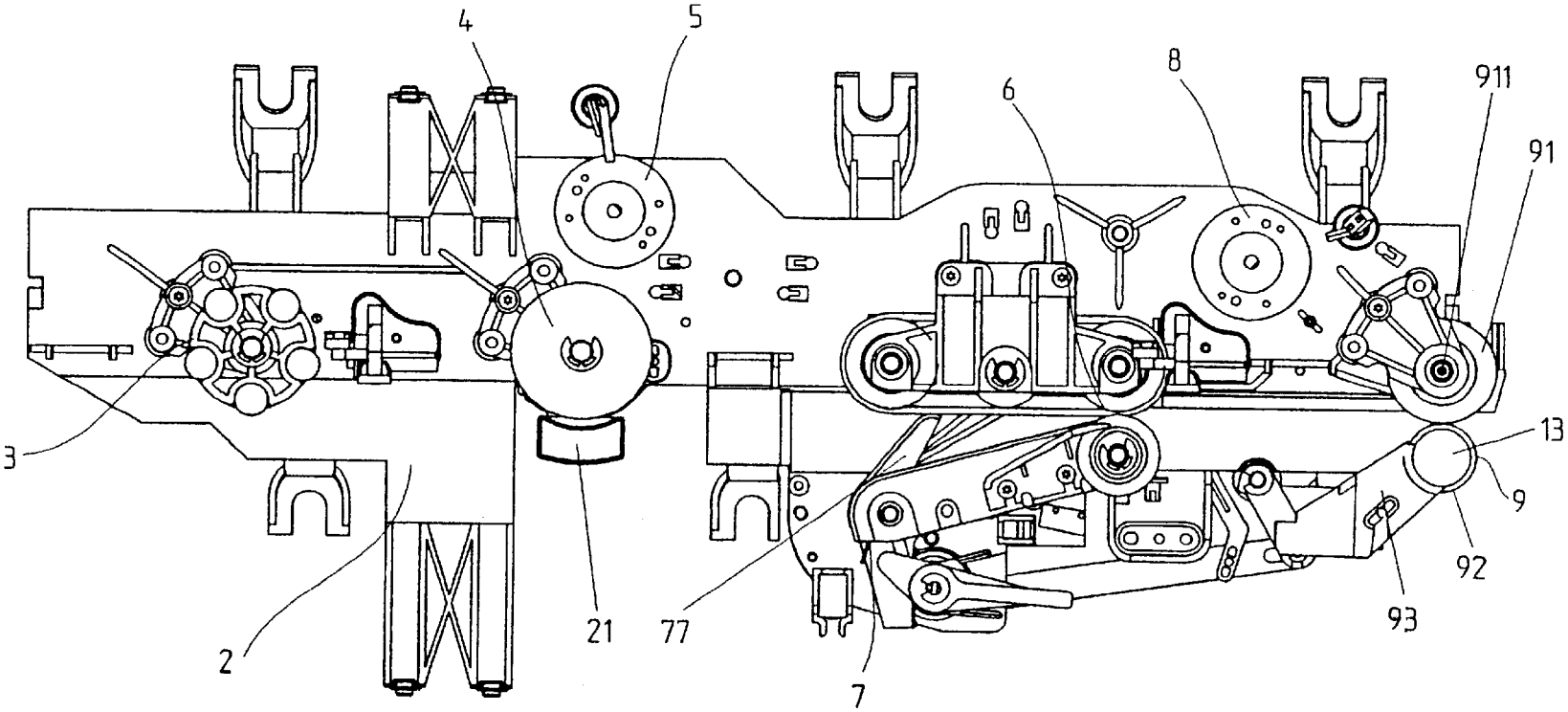
FIG. 4 is a partial plan view corresponding to FIG. 3.
Figure 5:
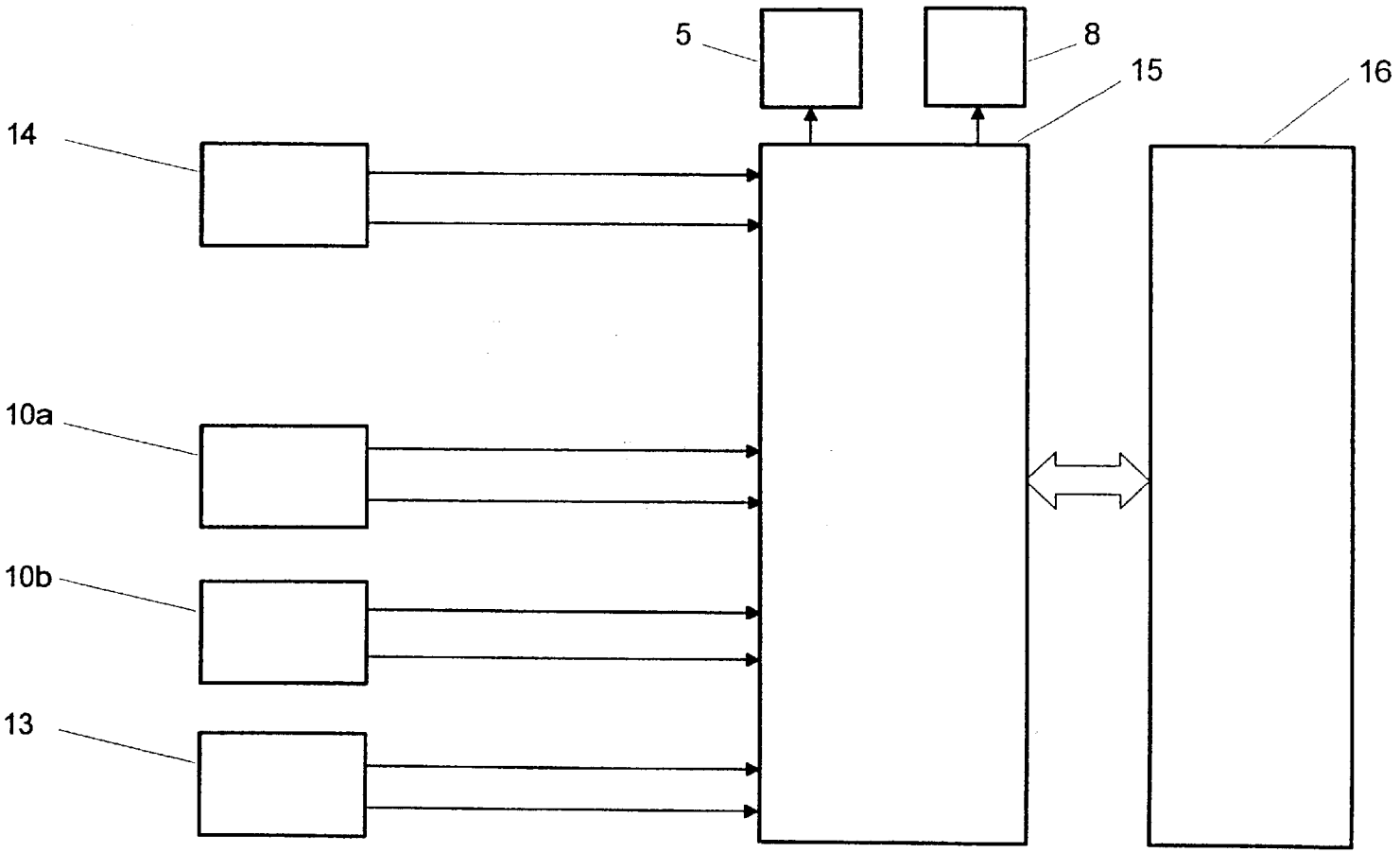
FIG. 5 is a block diagram relating to control of drives in the separating apparatus.

A first sensor 13 which is disposed on the rotatable shaft 921 for the indirectly driven ejection roll 92 is provided for measuring the transport speed of the letter A at this point. As is seen in FIGS. 4 and 5, the sensor 13 is constructed as an encoder that supplies an output signal. The output signal is compared, through the use of the evaluation circuit 15, with a signal corresponding to the transport speed in a following device 16, and a signal for controlling the common drive 8 in the separating area II and the drive 5 in the pre-separating area I is derived therefrom.

A letter A which passes through the ejection roll pair 91, 92 is moved linearly by the driven ejection roll 91 due to a frictional connection and transfers its movement, likewise by a frictional connection, synchronously to the spring-adjustable, indirectly driven ejection roll 92 as a rotational movement. The indirectly driven ejection roll is seated firmly on the shaft 921. Consequently, the rotational movement of the ejection roll 92 is transmitted to the shaft 921 and from the latter to the sensor 13.

Finally, a second sensor 14 which is also provided is disposed in an ejection region for the letters A, directly upstream or downstream of a line of contact between the ejection rolls 91, 92, in the guide plate 1. The sensor 14 is expediently likewise constructed as a reflection sensor. This sensor 14 is used to detect whether a letter A has reached the ejection area or left the latter and, in addition, requests or inquires as to the current transport speed in the following device 16, through the evaluation circuit 15.

According to FIG. 5, the sensors 10*a*, 10*b*, 14 for scanning letters are connected to the evaluation circuit 15, at the core of which are a microprocessor and a comparison circuit. The evaluation circuit 15 is bidirectionally connected to the following device or devices 16, especially to a control processor or processors thereof. The following device 16 may be a dynamic scale or balance and/or a franking machine. Furthermore, the evaluation circuit 15 is connected to the drive 5 of the pre-separating area I and to the drive 8 of the separating area II, for the purpose of outputting appropriate control signals.

The output signals from the sensors 10*a*, 10*b*, 14 are combined in the evaluation circuit 15 in such a way that the drive 5 in the pre-separating area I is set to accelerated transport if the sensor 10*a* does not detect a letter A, the drive 5 in the pre-separating area I is set to normal transport if the sensor 10*a* detects a letter A and the sensor 10*b* does not detect a letter A, the drive 5 in the pre-separating area I is set to idle if the sensor 10*a* and the sensor 10*b* detect a letter, the drive 8 in the separating area II is set to accelerated transport if the sensor 14 does not detect a letter A, and the drive 8 in the separating area II is set to normal transport if the sensor 10*b* detects a letter A, as is seen by referring to FIGS. 1 to 4 as well.

In this simple way, reliable control of the passage in the separating apparatus b is implemented merely by scanning a letter and measuring the speed of the letter in the ejection area.

We claim:

1. A method for controlling the passage of printed media in a mail processing system, which comprises:

transporting printed media laterally away from a stack;

providing a separating apparatus with different successive functional areas and a transition area between the functional areas;

transporting the printed media more quickly in the functional area preceding the transition area, than in the transition area, until a printed medium has reached the transition area;

transferring the printed media at a transfer speed to a following device having a transport speed; and adapting the transfer speed leading to the following device to the transport speed of the following device.

2. The method according to claim 1, which further comprises:

functionally dividing the separating apparatus into a pre-separating area having a separate drive with start/stop operation, and a separating area having an input area, and a separate drive with continuous operation;

transferring the printed media to the following device with an ejector in an ejection area;

setting a transport speed in the separating area to be higher than the transfer speed, corresponding to accelerated transport, until a printed medium has passed into the ejection area;

setting the transport speed in the separating area to be at most equal to the transfer speed, corresponding to normal transport, as long as there is a printed medium in the ejection area;

setting a transport speed in the pre-separating area to be higher than the transfer speed, corresponding to accelerated transport, and higher than the transport speed in the separating area, as long as there is no printed medium in the input area of the separating area;

setting the transport speed in the pre-separating area to be at most equal to the transport speed in the separating area, corresponding to normal transport, if a printed medium has reached the input area of the separating area and there is no further printed medium upstream of the ejection area; and setting the transport speed in the pre-separating area to zero by switching to idle, corresponding to idling or stopped operation, as long as there is a printed medium in the input area and in the other areas of the separating area.

3. The method according to claim 2, which further comprises continuously measuring the transfer speed and comparing and matching the transfer speed with the transport speed of the following device to yield a result, and using the result as a control signal for the drive in the separating area and the drive in the pre-separating area.

4. The method according to claim 2, which further comprises scanning the printed medium in the input area of the separating area, for deriving appropriate control signals for the drive in the pre-separating area, in combination with further scanning results.

5. The method according to claim 2, which further comprises scanning the printed medium immediately after being separated, for deriving appropriate control signals for the drives in the pre-separating area and in the separating area, in combination with further scanning results.

6. The method according to claim 2, which further comprises scanning the printed medium in the ejection area of the separating apparatus, for deriving appropriate control signals from the scanning for the pre-separating area, the separating area and the following device.

7. The method according to claim 2, which further comprises:

setting the transfer speed to be at most equal to the transport speed in the following device;

setting the transport speed in an initial area of the separating area to be lower than the transfer speed, as long as there is a printed medium in the ejection area; and setting the transport speed in the pre-separating area to be higher than the transfer speed, in the case of accelerated transport.

8. The method according to claim 2, which further comprises:

setting the transfer speed to be at most equal to the transport speed in the following device;

setting the transport speed in the initial area of the separating area to be 10% lower than the transfer speed, as long as there is a printed medium in the ejection area; and setting the transport speed in the pre-separating area to be 30% higher than the transfer speed, in the case of accelerated transport.

9. The method according to claim 1, wherein the printed media are letters.

10. The method according to claim 1, wherein the printed media are envelopes.

11. In a mail processing system including a separating apparatus having a pre-separating area, a separating area and an ejection area, and a following device downstream of the separating apparatus, a configuration for controlling the passage of printed media in the mail processing system, the configuration comprising:

a drive disposed in the pre-separating area;

a drive disposed in the separating area;

a first encoder sensor for measuring a transfer speed of the printed media to the following device;

a second sensor disposed in the ejection area for scanning printed media;

a third sensor disposed in an input area of the separating area for detecting printed media;

a fourth sensor disposed downstream of an actual separation point in the separating area for detecting printed media; and an evaluation circuit connected to said first, second, third and fourth sensors, said evaluation circuit connected to said drives of the pre-separating and separating areas and bidirectionally connected to the following device, for outputting control signals.

12. The configuration according to claim 11, including:

an ejector in the ejection area having an ejection roll pair including a stationary driven ejection roll and a spring-adjustable, indirectly driven ejection roll;

said indirectly driven ejection roll connected synchronously to said first sensor;

said first sensor supplying an output signal; and said evaluation circuit comparing the output signal supplied by said first sensor with a value corresponding to a transport speed in the following device, to provide a result supplied as a control signal to said drives in the pre-separating area and the separating area.

13. The configuration according to claim 12, wherein said ejection rolls define a line of contact therebetween, and said second sensor is disposed upstream of said line of contact.

14. The configuration according to claim 12, wherein said ejection rolls define a line of contact therebetween, and said second sensor is disposed downstream of said line of contact.

15. The configuration according to claim 11, wherein said second, third and fourth sensors are reflection sensors.

16. The configuration according to claim 11, wherein:

said second, third and fourth sensors for detecting printed media supply output signals; and said evaluation circuit combines the output signals from said second, third and fourth sensors for:

setting said drive in the pre-separating area to accelerated transport if said third sensor does not detect a printed medium;

setting said drive in the pre-separating area to normal transport if said third sensor detects a printed medium and said fourth sensor does not detect a printed medium;

setting said drive in the pre-separating area to idle if said third sensor and said fourth sensor detect a printed medium;

setting said drive in the separating area to accelerated transport if said second sensor does not detect a printed medium; and setting said drive in the separating area to normal transport if said fourth sensor detects a printed medium.

17. The configuration according to claim 16, wherein the output signal from said second sensor is also used for communication with the following device.

* * * * *